US009605452B2

(12) United States Patent
Yoshino et al.

(10) Patent No.: US 9,605,452 B2
(45) Date of Patent: Mar. 28, 2017

(54) DOOR HANDLE APPARATUS

(71) Applicant: AISIN SEIKI KABUSHIKI KAISHA, Kariya-shi (JP)

(72) Inventors: Masaki Yoshino, Chita-gun (JP); Koichi Nagata, Chiryu (JP); Tatsuya Shimizu, Okazaki (JP); Masayuki Nomura, Nagakute (JP)

(73) Assignee: AISIN SEIKI KABUSHIKI KAISHA, Kariya-Shi, Aichi-Ken (JP)

( * ) Notice: Subject to any disclaimer, the term of this patent is extended or adjusted under 35 U.S.C. 154(b) by 245 days.

(21) Appl. No.: 14/072,005

(22) Filed: Nov. 5, 2013

(65) Prior Publication Data

US 2014/0132012 A1 May 15, 2014

(30) Foreign Application Priority Data

Nov. 12, 2012 (JP) ..... 2012-248145

(51) Int. Cl.
*E05B 3/00* (2006.01)
*E05B 5/00* (2006.01)
(Continued)

(52) U.S. Cl.
CPC ..... *E05B 85/103* (2013.01); *E05B 5/006* (2013.01); *E05B 83/10* (2013.01); *E05B 85/107* (2013.01);
(Continued)

(58) Field of Classification Search
CPC ..... E05B 81/64; E05B 85/103; E05B 5/006; E05B 85/107
(Continued)

(56) References Cited

U.S. PATENT DOCUMENTS 6,062,614 A * 5/2000 Petzold ..... E05B 85/14 292/336.3
6,698,262 B2 * 3/2004 Wittwer ..... E05B 85/107 292/336.3
(Continued)

FOREIGN PATENT DOCUMENTS

DE 3427178 A1 * 2/1986 ..... E05B 85/18
DE 10320058 A1 * 12/2004 ..... E05B 85/10
(Continued)

OTHER PUBLICATIONS

Office Action issued on Feb. 2, 2016, by the Japanese Patent Office in corresponding Japanese Patent Application No. 2012-248145 and an English translation of the Office Action. (4 pages).

*Primary Examiner* — Carlos Lugo
(74) *Attorney, Agent, or Firm* — Buchanan Ingersoll & Rooney PC

(57) ABSTRACT

A door handle apparatus includes: a handle body; a driven member; and a driving mechanism configured such that in a state where the driven member is at a first driving position, the handle body is positioned at a first handle position, and rotated to a second handle position by the driven member driven to a second driving position, and in a state where the driven member is at the second driving position, the handle body is rotatable or unrotatable from the second handle position in a first direction when subjected to a force in the first direction, and rotatable from the second handle position to a second direction opposite to the first direction when subjected to a force in the second direction, and the handle body is urged in the direction of being restored to the second handle position when rotating from the second handle position by the external force.

6 Claims, 13 Drawing Sheets

(51) Int. Cl.

| | |
|---|---|
| ***E05B 85/10*** | (2014.01) |
| ***E05B 83/10*** | (2014.01) |
| *E05B 81/06* | (2014.01) |
| *E05B 81/34* | (2014.01) |
| *E05B 81/42* | (2014.01) |
| *E05B 81/76* | (2014.01) |

(52) U.S. Cl.
CPC ..... *E05B 81/06* (2013.01); *E05B 81/34* (2013.01); *E05B 81/42* (2013.01); *E05B 81/76* (2013.01); *Y10T 292/57* (2015.04)

(58) Field of Classification Search
USPC ..... 292/336.3
See application file for complete search history.

(56) References Cited

U.S. PATENT DOCUMENTS

| | | | | |
|---|---|---|---|---|
| 8,690,204 | B2 * | 4/2014 | Lang | E05B 81/77 292/279 |
| 8,701,353 | B2 * | 4/2014 | Patel | E05B 81/34 292/144 |
| 9,062,478 | B2 * | 6/2015 | Bingle | E05B 81/28 |
| 9,080,352 | B2 * | 7/2015 | Aerts | E05B 85/103 |
| 9,103,143 | B2 * | 8/2015 | Wheeler | B60Q 3/002 |
| 2011/0148575 | A1 * | 6/2011 | Sobecki | E05B 85/107 340/5.64 |
| 2014/0265372 | A1 | 9/2014 | Smart | |

FOREIGN PATENT DOCUMENTS

| | | | | |
|---|---|---|---|---|
| DE | EP 1607556 | A1 * | 12/2005 | E05B 81/76 |
| DE | WO 2008129003 | A2 * | 10/2008 | E05B 85/107 |
| DE | 102008030580 | A1 * | 1/2009 | E05B 85/107 |
| EP | 2 723 959 | A | 4/2014 | |
| GB | 2492319 | * | 1/2013 | |
| JP | 05-034266 | U | 5/1993 | |
| JP | 7-269177 | A | 10/1995 | |
| JP | 2004-244991 | A | 9/2004 | |
| JP | 2008-248632 | A | 10/2008 | |
| WO | 2012/175647 | A2 | 12/2012 | |

* cited by examiner

DOOR HANDLE APPARATUS

CROSS REFERENCE TO RELATED APPLICATIONS

This application is based on and claims priority under 35 U.S.C. §119 to Japanese Patent Application 2012-248145, filed on Nov. 12, 2012, the entire content of which is incorporated herein by reference.

TECHNICAL FIELD

This disclosure relates to a door handle apparatus for a vehicle.

BACKGROUND DISCUSSION

In the related art, a door handle apparatus having a door handle body provided on a vehicle door on a surface outside of a cabin and formed into a grip shape to be griped when the door is opened as described, for example, in JP 2004-244991A (Reference 1) is known. In general, the door of the vehicle is provided with a door body formed of an outer panel arranged on the outside of the cabin and an inner panel arranged on the inside of the cabin joined together. A space is provided between the outer panel and the inner panel, and the door handle apparatus is inserted into the space (that is, in the interior of the door body), and is fixed to the outer panel. The door handle body of the door handle apparatus described in JP 2004-244991A (Reference 1) is supported so as to be capable of rotating on a rotary shaft provided at one end portion. In a state in which the door is not operated to be opened or closed such as during travel or parking, the door handle body is stored in the door body. In other words, the door handle body is standstill at a first handle position (initial position) where the side surface thereof on the outside of the cabin and the side surface of the door panel on the outside of the cabin is positioned on an identical plane. Accordingly, design of the door is improved, and wind drag during travel is reduced. In this state, the user is not allowed to grip the door handle body. In contrast, when the door is opened from the outside of the vehicle, the door handle body rotates so that the other end portion thereof protrudes outward from the cabin with respect to the side surface of the door panel on the outside of the cabin and stops at a predetermined second handle position. In this state, the user is allowed to grip the door handle body. The door remains closed until the user grips the door handle body and rotates the door body toward the outside of the cabin.

Specifically, the door handle apparatus includes an actuator composed of a solenoid or an electric motor configured to rotate the door handle body from the first handle position to the second handle position. When the user presses a button provided on a handheld unit, a signal indicating that the door handle body is to be rotated is emitted from the handheld unit. This signal is received by a control unit provided in a vehicle body. The control unit drives the actuator when being subjected to the signal, and rotates the door handle body from the first handle position to the second handle position. Accordingly, a state in which the user is allowed to grip the door handle body is assumed.

An action taken when the user erroneously rotates the door handle body in a state of being at the second handle position toward the first handle position is not described In JP-A-2004-244991. In view of a configuration of this door handle apparatus, when the door handle body is rotated toward the first handle position in a state in which the door handle body is at the second handle position, the door handle body stops at the first handle position. Therefore, when the user opens the door, the user is required to press the button provided on the handheld unit again to restore the door handle body to the second handle position. When the user erroneously causes the door handle body to be rotated from the second handle position to the first handle position, time and efforts are required to restore the door handle body to the second handle position.

SUMMARY

Thus, a need exists for a door handle apparatus which is not suspectable to the drawback mentioned above. In order to facilitate understanding of this disclosure, components of this disclosure are individuated by reference numerals of corresponding components of embodiments in parentheses. However, the components of this disclosure are not to be limitedly understood to be the configuration of the corresponding parts individuated by reference numerals of the embodiments.

An aspect of this disclosure is directed to a door handle apparatus (1) configured to be assembled to a door body (D) of a vehicle including: a door handle body (10) configured to be supported so as to be capable of rotating by the door body; a driven member (54) configured to be supported by the door body and driven by an actuator (51); and a handle driving mechanism configured in such a manner that in a state in which the driven member is at a first driving position, the door handle body is positioned at a first handle position, and is rotated from the first handle position to a second handle position by the driven member being driven from the first driving position to a second driving position by an operation of the actuator, and in a state in which the driven member is at the second driving position, the door handle body is capable of or incapable of rotating from the second handle position in a first rotating direction when being subjected to an external force in the first rotating direction from the second handle position to the first handle position, and is capable of rotating from the second handle position to a second rotating direction opposite to the first rotating direction when being subjected to an external force in the second rotating direction, and the door handle body is subjected to an urging force in the direction of being restored to the second handle position when rotating from the second handle position by being subjected to the external force.

According to this configuration, in a state in which the driven member is positioned at the second driving position, the door handle body is restored to the second handle position again even when the door handle body is subjected to the external force and rotates from the second handle position in the first rotating direction. In other words, the door handle body is incapable of rotating from the second handle position in the first rotating direction. Therefore, different from the door handle apparatus of the related art described above, an operation to restore the door handle body to the second handle position is not necessary. Therefore, the operability is further improved in comparison with the door handle apparatus of the related art.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Figure 1:
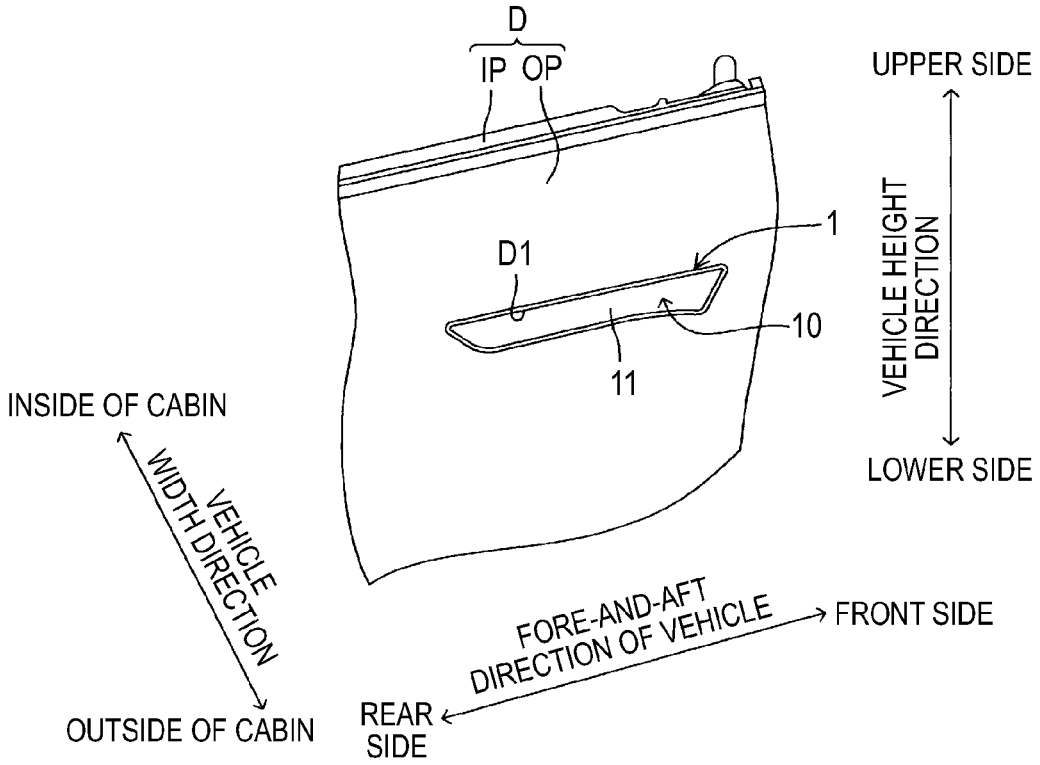
FIG. 1 is a perspective view of a vehicle door in which a door handle apparatus according to an embodiment disclosed herein is assembled.

Referring now to the drawings, a door handle apparatus 1 according to an embodiment disclosed here will be described. First of all, an outline of the door handle apparatus 1 will be described. The door handle apparatus 1 is assembled to a door body D of a vehicle as illustrated in FIG. 1. The door body D is provided with an outer panel OP arranged on the outside of a cabin and an inner panel IP arranged on the inside of the cabin joined together. A space is provided between the outer panel OP and the inner panel IP, and the door handle apparatus 1 is arranged in the space (that is, in the interior of the door body D). The door handle apparatus 1 includes a door handle body 10 formed into a grip shape so as to be gripped when a door of the vehicle is opened. The outer panel OP is formed with a through hole D1 penetrating therethrough in the vehicle width direction. The shape of the through hole D1 corresponds to an outer shape of the door handle body 10. The door handle body 10 is in a state of being accommodated in the door body D so that a user is not allowed to grip the door handle body 10 in a normal state (during travel or parking), and protrudes outward of the cabin from the through hole D1 when the door is opened so that the user is allowed to grip the door handle body 10.

Figure 2:
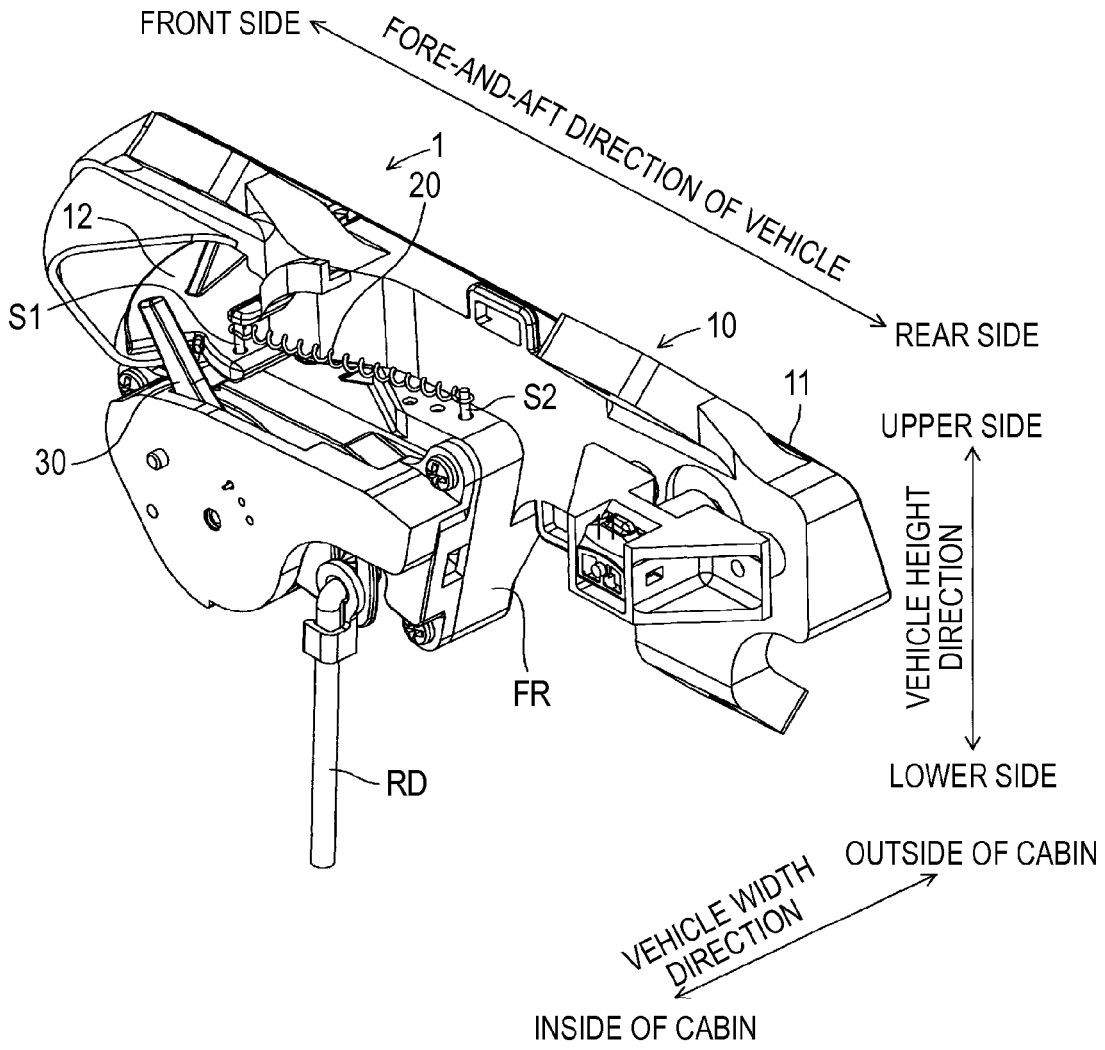
FIG. 2 is a perspective view of the door handle apparatus illustrated in FIG. 1 from the rear in the inside of a cabin.
Figure 3:
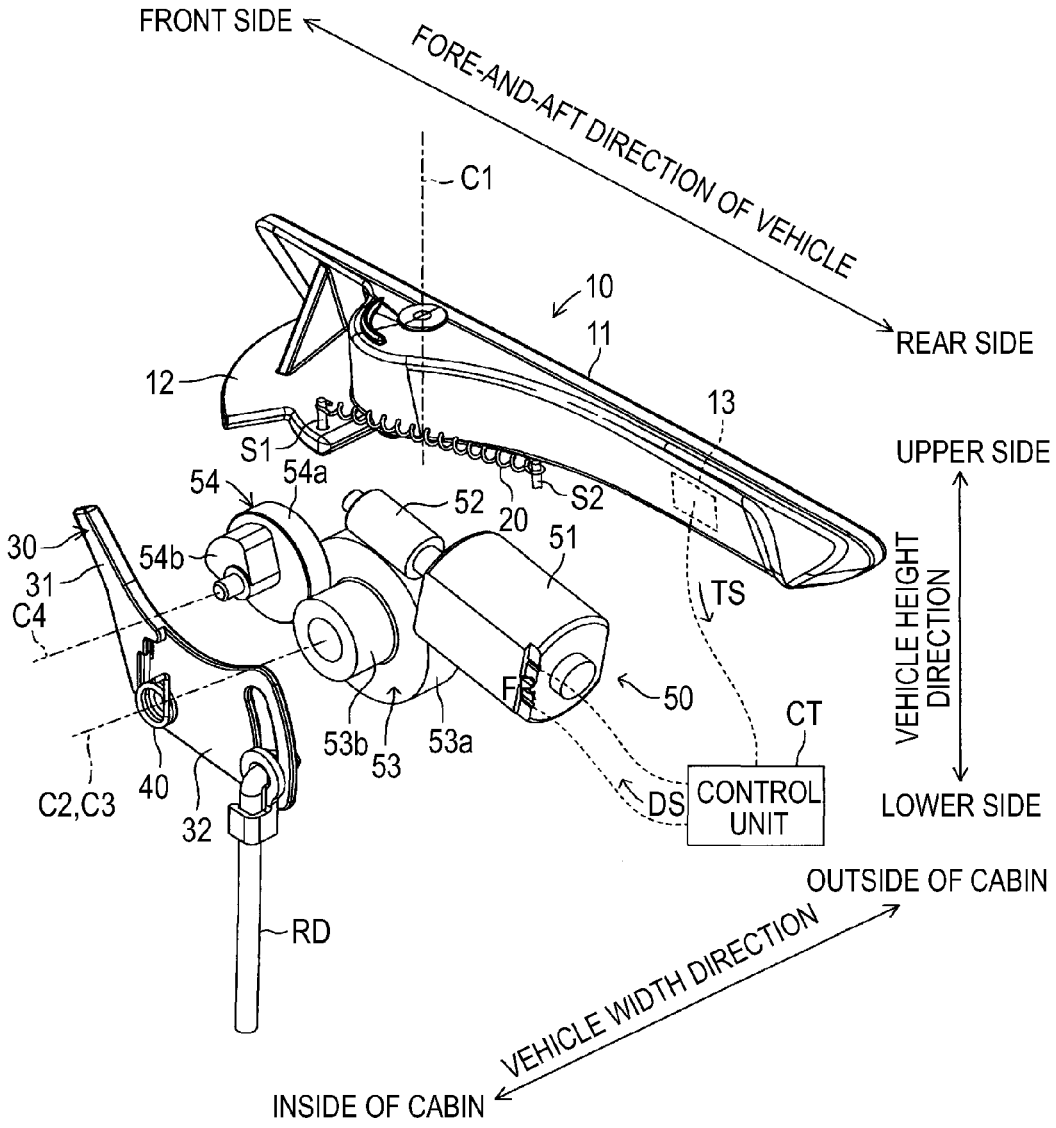
FIG. 3 is an exploded perspective view of the door handle apparatus in FIG. 1.
Figure 4:
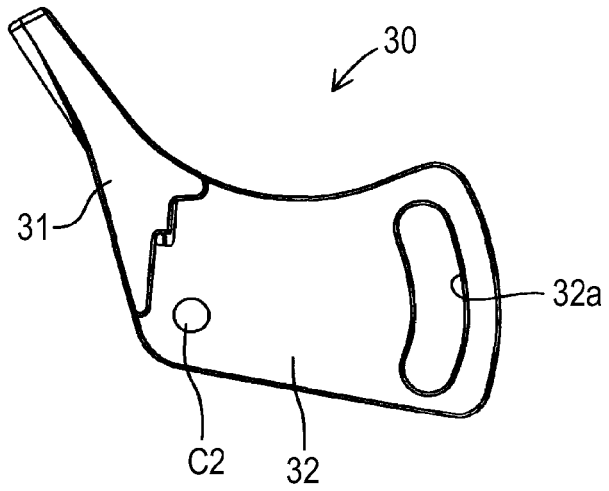
FIG. 4 is an enlarged drawing of a lever.

Subsequently, a configuration of the door handle apparatus 1 will be described. The door handle apparatus 1 is provided with a frame FR configured to support respective components described below as illustrated in FIG. 2. In FIG. 3 to FIG. 17 described below, part or an entire part of the frame FR is omitted in order to make the internal structure of the door handle apparatus 1 visible. The door handle body 10 is supported by the frame FR so as to be capable of rotating on a rotary shaft C1 extending in the vehicle height direction as illustrated in FIG. 3 to FIG. 5. The door handle body 10 includes a gripping portion 11 extending in a fore-and-aft direction of the vehicle in a state of being accommodated in the door body D. The door handle body 10 is provided with a plate-shaped supporting portion 12 formed so as to protrude inward of the vehicle cabin from a lower end portion of the gripping portion 11 at a front end portion thereof. The supporting portion 12 is formed into a substantially fan shape with the rotary shaft C1 positioned at a center thereof. The supporting portion 12 is formed with a supporting rod 51 extending upward on the upper surface thereof. One end of a tension spring 20 is assembled to an upper end portion of the supporting rod S1. The other end of the tension spring 20 is assembled to a supporting rod S2 extending upward from an upper surface of the frame FR at a position on the rear side of the supporting rod S1. The door handle body 10 is urged so as to rotate counterclockwise by the tension spring 20 when viewed from above.

A side surface on the outside of the vehicle of the door handle body 10 includes a touch-sensitive sensor 13 (for example, an electrostatic capacity sensor) integrated therein. The sensor 13 is connected with a cable, not illustrated, to a control unit CT provided in the vehicle body, and transmits a signal TS indicating the fact that the door handle body 10 is touched to the control unit CT. The control unit CT drives an actuator 50 described later, with the signal TS as a trigger.

A lever 30 is arranged at a position rearward of the supporting portion 12 (see FIG. 2). The lever 30 is formed into a plate shape perpendicular to a vehicle width direction. The lever 30 is supported by the frame FR so as to be capable of rotating on a rotary shaft C2 extending in the vehicle width direction. The lever 30 includes a first arm portion 31 extending toward the supporting portion 12 and a second arm portion 32 extending in a direction at an angle of approximately 120° advanced clockwise with respect to the first arm portion 31 when viewed from the inside of the cabin as illustrated in FIG. 4. The first arm portion 31 is tapered toward a distal end thereof. The second arm portion 32 is formed so as to increase in width toward the distal end thereof. The surface of the first arm portion 31 on the outside of the cabin and the surface of the second arm portion 32 on the outside of the cabin are flush with each other. The thickness of the first arm portion 31 is formed to be thicker than the second arm portion 32. A shoulder is formed at a boundary between the first arm portion 31 and the second arm portion 32. One end of a torsion coil spring 40 is in abutment with the shoulder. The other end of the torsion coil spring 40 is supported by the frame FR. A center axis of the torsion coil spring 40 is positioned on the same straight line as the rotary shaft C2. The lever 30 is urged by the torsion coil spring 40 so as to rotate counterclockwise on the rotary shaft C2 when viewed from the inside of the cabin. The strength of the tension spring 20 and the strength of the torsion coil spring 40 are set respectively so that the first arm portion 31 of the lever 30 urged by the torsion coil spring 40 comes into abutment with a rear end surface of the supporting portion 12 of the door handle body 10 and the door handle body 10 is capable of rotating clockwise (first rotating direction) when viewed from above by pressing the supporting portion 12 forward against the urging force of the tension spring 20 assembled to the supporting portion 12.

The second arm portion 32 is formed with a through hole 32*a* extending around the rotary shaft C2. One end of a rod RD extending in the vehicle height direction is assembled to the through hole 32*a*. The one end of the rod RD is configured to be slidable along the through hole 32*a*. The other end of the rod RD is assembled to a latch device, not illustrated, configured to hold the door in the closed state.

The actuator 50 configured to rotate the lever 30 on the rotary shaft C2 is provided lateral to the lever 30, that is, on the outer side of the cabin. The actuator 50 includes an electric motor 51, a worm gear 52 assembled to an output shaft of the electric motor 51, a two-stage toothed gear 53 arranged so as to engage the worm gear 52 and rotates in association with the rotation of the worm gear 52, and a cam 54 rotating in association with the rotation of the two-stage toothed gear 53. The electric motor 51 is supported by the frame FR. The electric motor 51 rotates in accordance with a drive signal DS supplied from the control unit CT via a cable, not illustrated. The two-stage toothed gear 53 and the cam 54 are supported by the frame FR so as to be capable of rotating about a rotary shaft C3 and a rotary shaft C4 extending in the vehicle width direction respectively. The rotary shaft C3 of the two-stage toothed gear 53 and the rotary shaft C2 of the lever 30 are arranged on the same straight line. The rotary shaft C4 of the cam 54 is positioned forward of the rotary shaft C2 of the lever 30 and the rotary shaft C3 of the two-stage toothed gear 53.

Figure 5A:
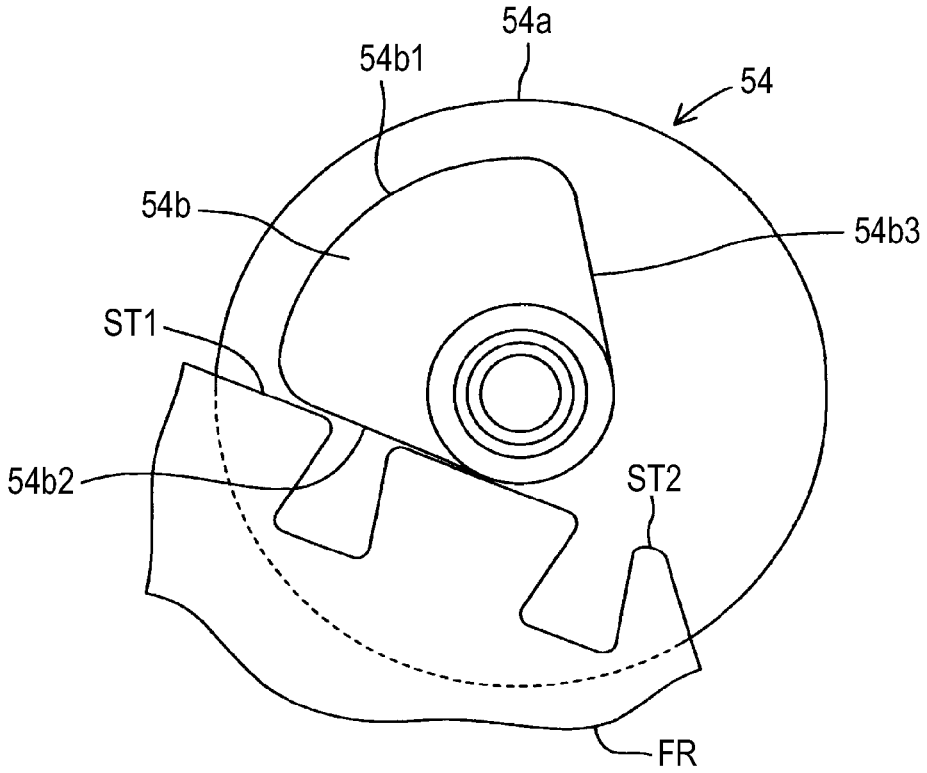
FIG. 5A is an enlarged drawing illustrating a state where a cam is positioned at a first cam position.
Figure 5B:
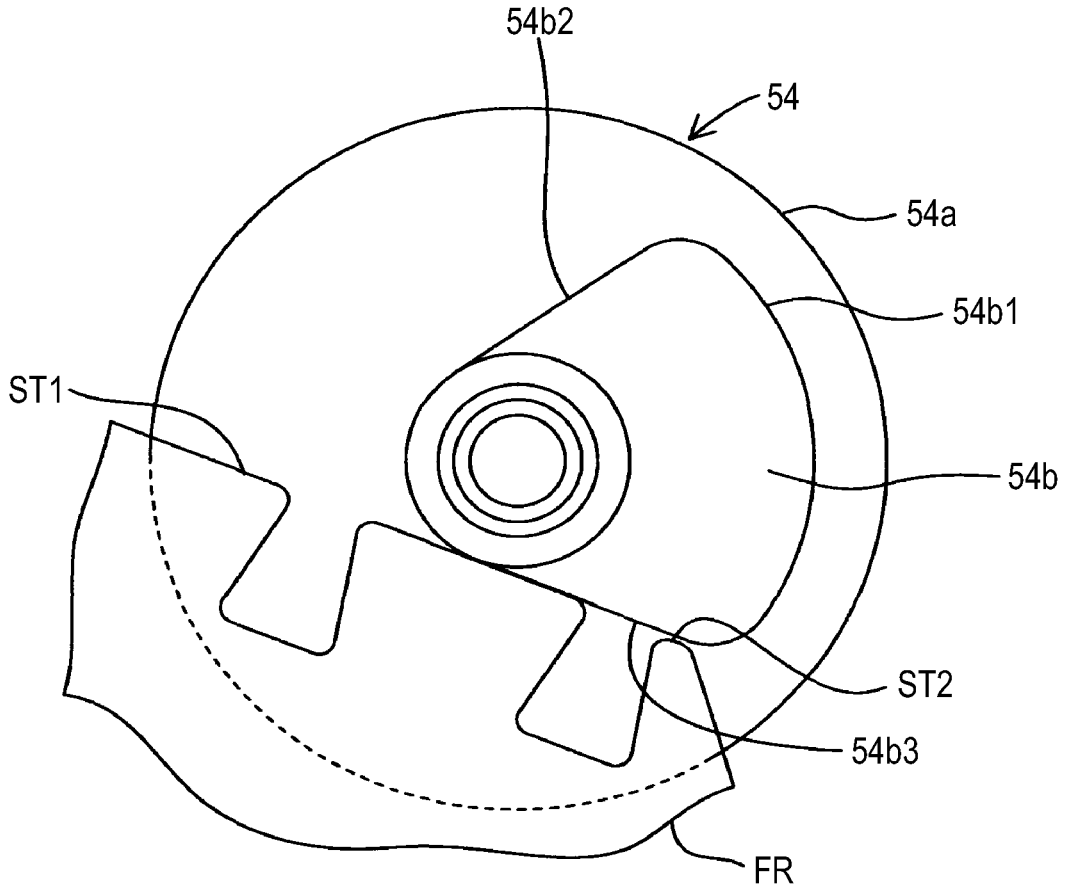
FIG. 5B is an enlarged drawing illustrating a state where a cam is positioned at a second cam position.

The two-stage toothed gear 53 includes a worm wheel portion 53*a* configured to engage the worm gear 52, and a spur gear portion 53*b* formed integrally with a surface of the worm wheel portion 53*a* on the inner side of the cabin. An outer diameter of the spur gear portion 53*b* is smaller than an outer diameter of the worm wheel portion 53*a*. The cam 54 includes a spur gear portion 54*a* engaging the spur gear portion 53*b* of the two-stage toothed gear 53, and a cam portion 54*b* formed integrally on a surface of the spur gear portion 54*a* on the inner side of the cabin. The cam portion 54*b* is formed into a fan shape when viewed from the inside of the cabin. In other words, the cam portion 54*b* includes an arcuate surface portion 54*b*1 formed into an arcuate surface shape, and flat surface portions 54*b*2 and 54*b*3 formed into a flat shape from both end portions of the arcuate surface portion 54*b*1 in the circumferential direction toward the rotary shaft C4. As illustrated in FIGS. 5A and 5B, the frame FR is provided with stoppers ST1 and ST2 configured to restrict the rotation of the cam 54 by coming into abutment with the flat surface portions 54*b*2 and 54*b*3 respectively. The counterclockwise rotation of the cam 54 when viewed from the inside of the cabin is restricted by an abutment of the flat surface portion 54*b*2 against the stopper ST1 (FIG. 5A). The rotational position of the cam 54 in this state is referred to as a first cam position. The clockwise rotation of the cam 54 when viewed from the inside of the cabin is restricted by an abutment of the flat surface portion 54*b*3 against the stopper ST2 (FIG. 5B). The rotational position of the cam 54 in this state is referred to as a second cam position. The cam 54 is rotated about the rotary shaft C4 in a state that the lever 30 abuts against the cam portion 54*b* by being urged by the torsion coil spring 40, whereby the lever 30 rotates on the rotary shaft C2.

Figure 6:
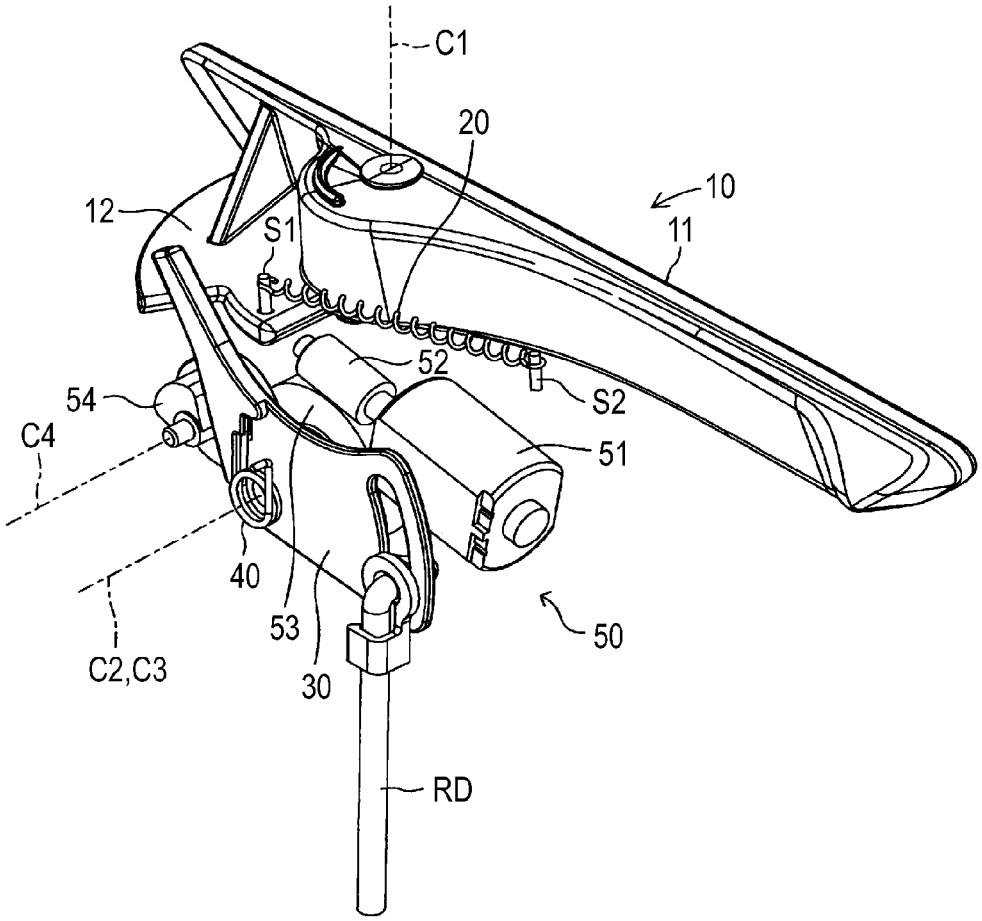
FIG. 6 is a perspective view of the door handle apparatus in a state in which a door handle body is positioned at a first handle position viewed from the rear in the inside of the cabin.
Figure 7:
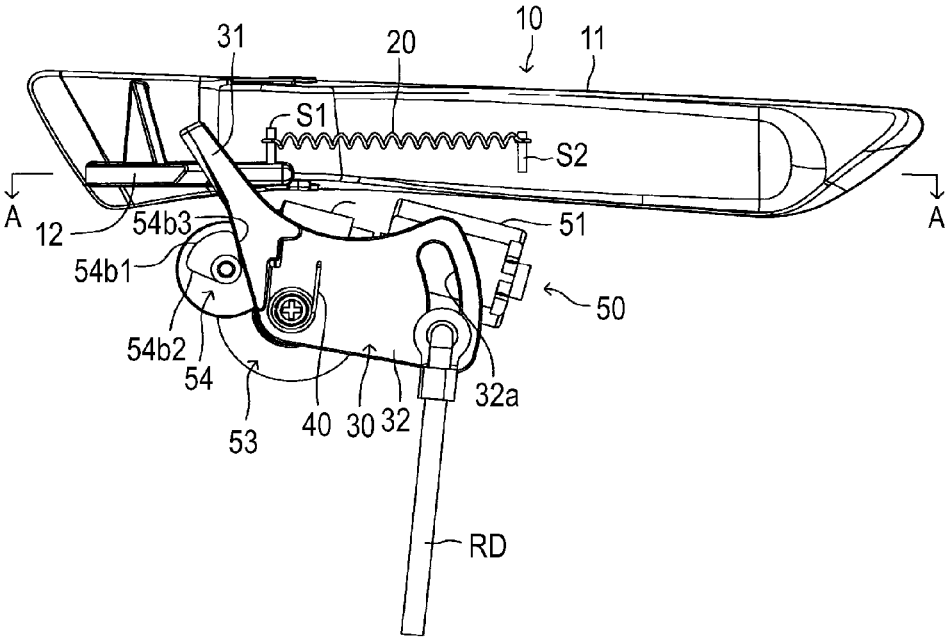
FIG. 7 is a front view of the door handle apparatus illustrated in FIG. 6 viewed from the inside of the cabin.
Figure 8:
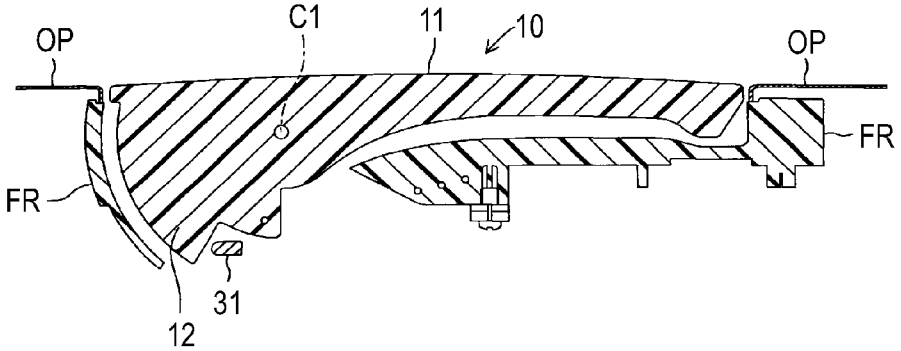
FIG. 8 is a cross-sectional view taken along the line VIII-VIII in FIG. 7.

An operation of the door handle apparatus 1 configured as described above will be described. As illustrated in FIG. 6 to FIG. 8, the cam 54 stands still at the first cam position in the normal state. The lever 30 is urged by the torsion coil spring 40 and rotates counterclockwise (third rotating direction) when viewed from the inside of the cabin, and a front surface (first engaging portion) of the first arm portion 31 stands still in abutment with the flat surface portion 54*b*3 of the cam 54. The rotational position of the lever 30 in this state is referred to as a first lever position. When the lever 30 rotates counterclockwise when viewed from the inside of the cabin, the rear surface (second engaging portion) of the supporting portion 12 of the door handle body 10 is pressed forward by the first arm portion 31 of the lever 30, whereby the door handle body 10 is rotated clockwise (the first rotating direction) when viewed from above. When the lever 30 abuts against the flat surface portion 54*b*3 of the cam portion 54*b*, the door handle body 10 also stops. In this state, the door handle body 10 is accommodated in the door body D. In other words, the surface of the door handle body 10 on the outside of the cabin and the surface of the outer panel OP on the outside of the cabin are flush with each other. The rotational position of the door handle body 10 in this state is referred to as a first handle position. In this state, the user is not allowed to grip the gripping portion 11. In this state, an upper end of the rod RD is raised upward by abutting against a lower end of the through hole 32*a* of the lever 30, and is held (latched) in a state in which the door is closed by the latch device.

When the sensor 13 provided in the door handle body 10 is touched in a state in which the door handle body 10 is accommodated in the door body D, the sensor 13 transmits the signal TS indicating the fact that the door handle body 10 is touched to the control unit CT. The control unit CT supplies the drive signal DS to the electric motor 51 upon reception of the signal TS and rotates the electric motor 51 in the normal direction to rotate the cam 54 toward the second cam position. Accordingly, a front end surface of the lever 30 is pressed rearward by the cam portion 54*b* of the cam 54, and the lever 30 rotates clockwise (fourth rotating direction) when viewed from the inside of the cabin. The supporting portion 12 of the door handle body 10 is pulled rearward by the tension spring 20, so that the door handle body 10 rotates counterclockwise (second rotating direction) when viewed from above in a state in which the supporting portion 12 is kept in abutment with the first arm portion 31 in association with the rearward movement of the first arm portion 31 by the rotation of the lever 30. As described above, the through hole 32*a* extends around the rotary shaft C2 of the lever 30, and the upper end of the rod RD is slidable along the through hole 32*a*, so that the upper position of the rod RD does not change when the lever 30 rotates. Therefore, the door is held in a state of being closed by the latch device.

Figure 9:
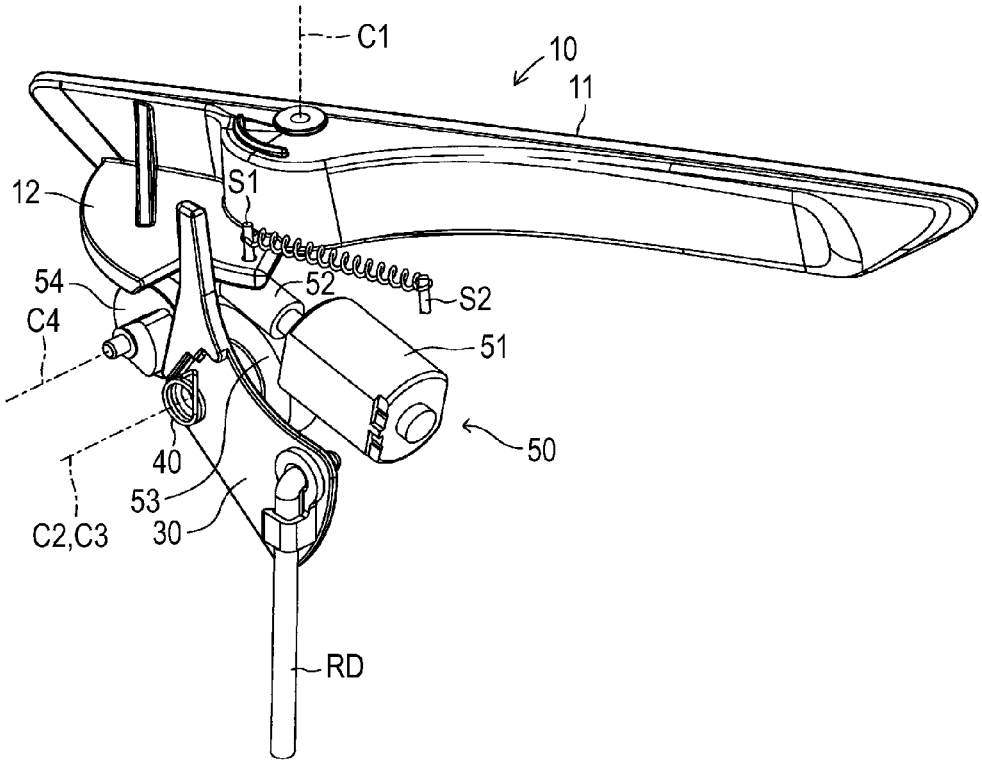
FIG. 9 is a perspective view of the door handle apparatus in a state in which the door handle body is positioned at a second handle position viewed from the rear in the inside of the cabin.
Figure 10:
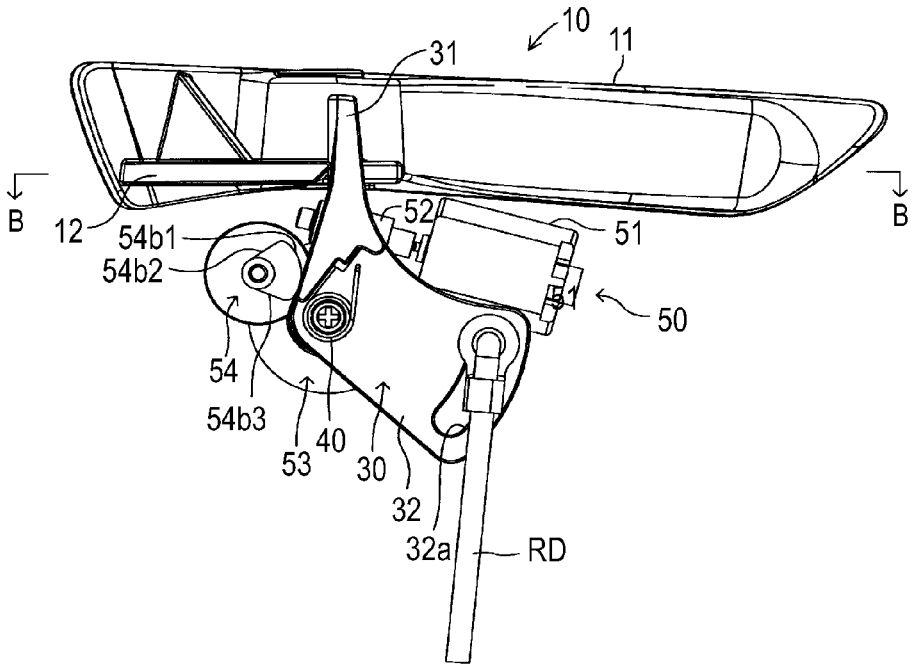
FIG. 10 is a front view of the door handle apparatus illustrated in FIG. 9 viewed from the inside of the cabin.
Figure 11:
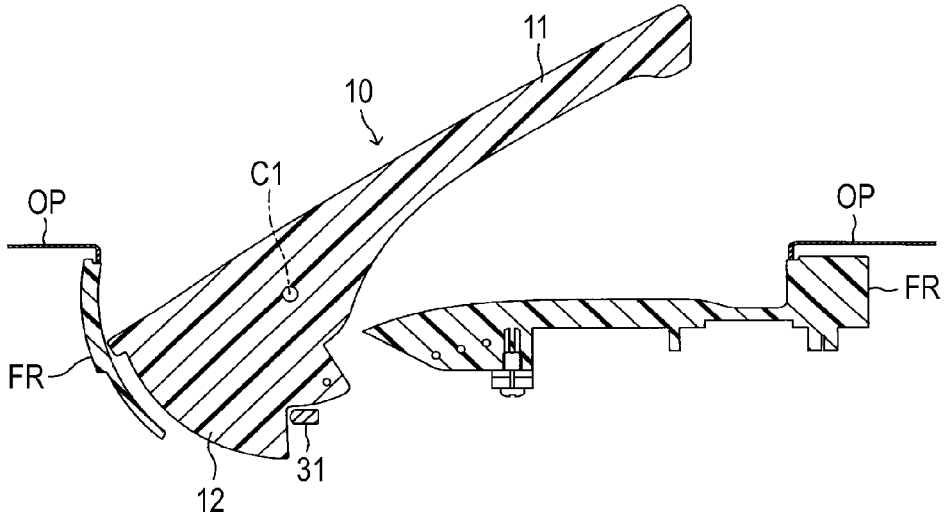
FIG. 11 is a cross-sectional view taken along the line XI-XI in FIG. 10.

As illustrated in FIG. 9 to FIG. 11, when the flat surface portion 54*b*3 of the cam 54 comes into abutment with the stopper ST2, the rotation of the cam 54 is restricted. In other words, the cam 54 is stopped at the second cam position. In association with the stop of the cam 54, the lever 30 and the door handle body 10 also stop. In this state, a rear end portion of the gripping portion 11 protrudes slightly to the outside of the cabin, and hence the user is allowed to grip the gripping portion 11. The rotational positions of the lever 30 and the door handle body 10 in this state are referred to as a second lever position and a second handle position, respectively. In this state, the upper end of the rod RD abuts against an upper end of the through hole 32*a*.

Figure 12:
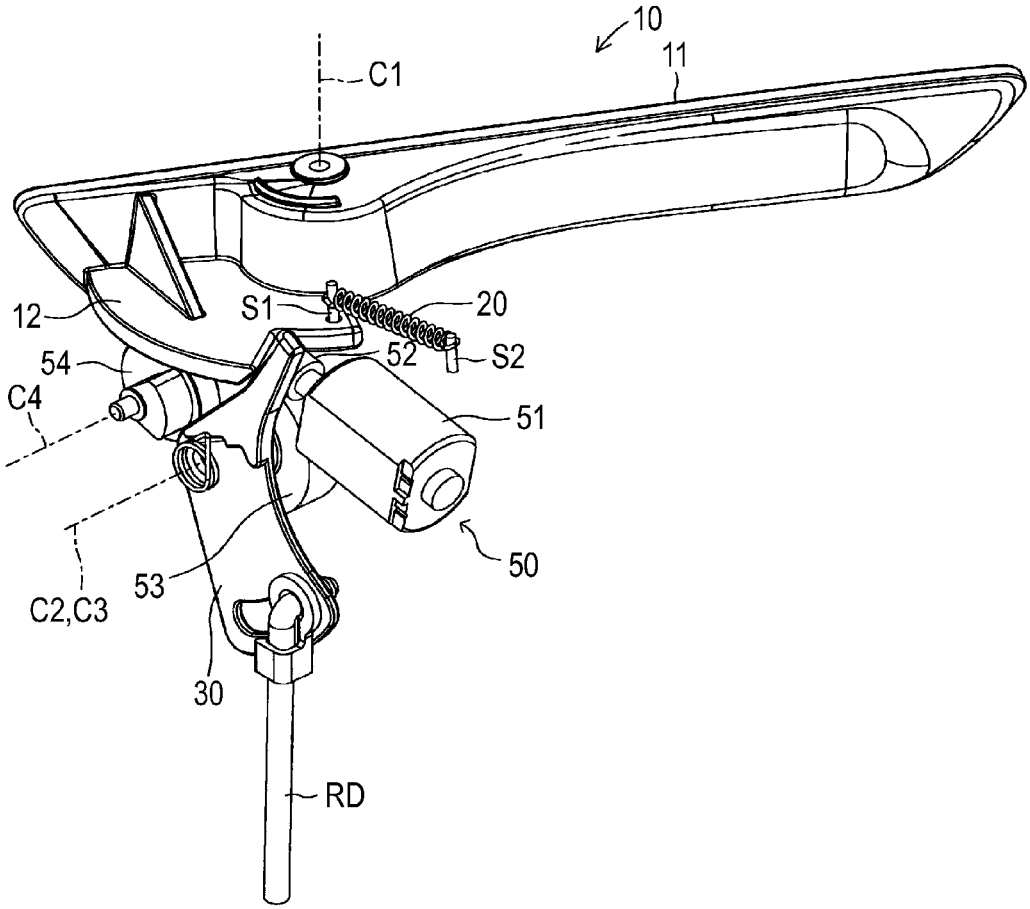
FIG. 12 is a perspective view of the door handle apparatus in a state in which the door handle body is positioned at a third handle position viewed from the rear in the inside of the cabin.
Figure 13:
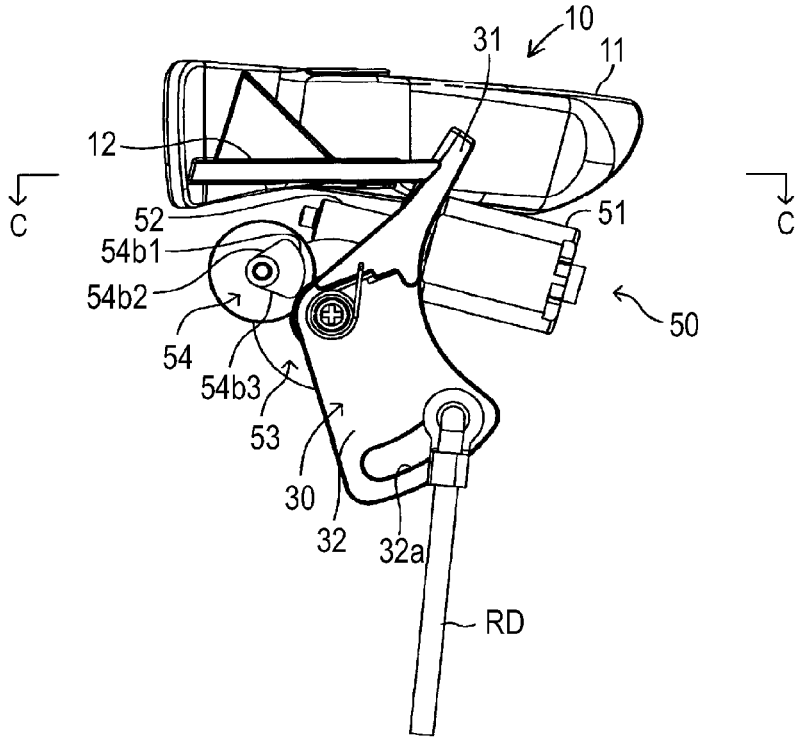
FIG. 13 is a front view of the door handle apparatus illustrated in FIG. 12 viewed from the inside of the cabin.
Figure 14:
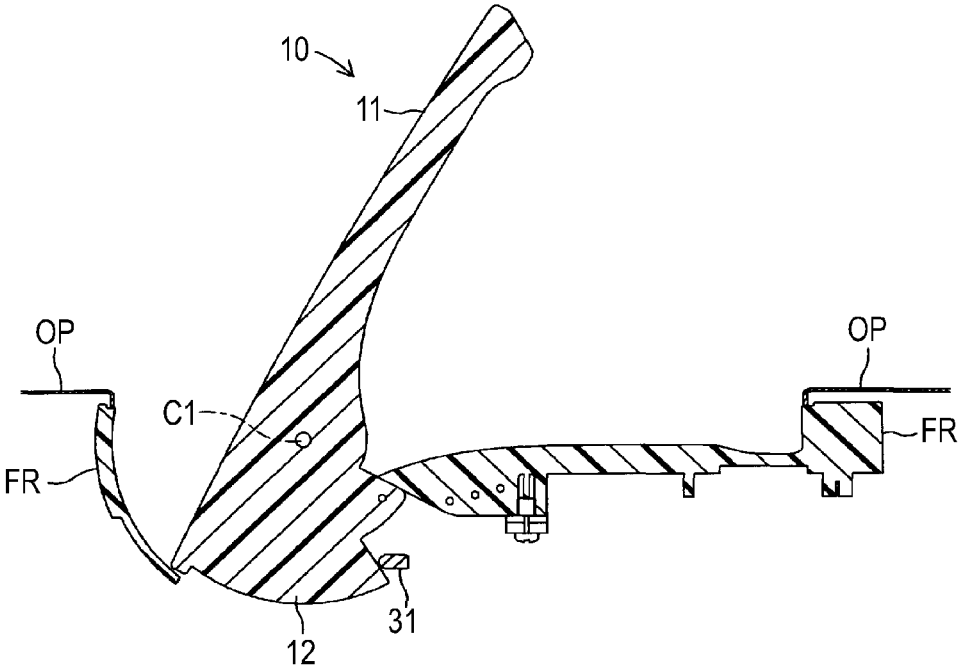
FIG. 14 is a cross-sectional view taken along the line XIV-XIV in FIG. 13.

When the user grips the gripping portion 11 and applies a force to rotate the door handle body 10 further in the same direction (the second rotating direction) as a direction from the first handle position to the second handle position in a state in which the door handle body 10 is at the second handle position, the first arm portion 31 of the lever 30 is pressed rearward by the supporting portion 12 as illustrated in FIG. 12 to FIG. 14, and the lever 30 rotates in the same direction as a direction in which the lever 30 moves from the first lever position to the second lever position (the fourth rotating direction). Accordingly, the rod RD is pressed downward and latched state effected by the latch device is released, so that the door can be opened. When the supporting portion 12 comes into abutment with the frame FR, the door handle body 10 and the lever 30 stop rotational movements. The rotational positions of the door handle body 10 and the lever 30 in this state are referred to as a third handle position and a third lever position respectively. When the lever 30 rotates from the second lever position to the third lever position, the lever 30 moves away from the cam portion 54*b*.

When the user moves his or her hand away from the door handle body 10 in a state in which the door handle body 10 is positioned at the third handle position, the lever 30 is urged by the torsion coil spring 40, rotates toward the second lever position (in the third rotating direction), and a front end surface thereof comes into abutment with the arcuate surface portion 54*b*1 of the cam portion 54*b*, and hence stops at the second lever position. In association with the stop of the lever 30, the supporting portion 12 of the door handle body 10 is pressed forward by the first arm portion 31 of the lever 30, so that the door handle body 10 rotates from the third handle position to the second handle position (in the first rotating direction), and stops at the second handle position.

In a state in which the lever 30 is at the second lever position, the front end surface of the lever 30 is in abutment with the arcuate surface portion 54*b*1 of the cam portion 54*b*. Accordingly, the lever 30 is restricted from rotating in the direction toward the first lever position (the third rotating direction). Therefore, when the user applies a force to rotate the door handle body 10 in the direction toward the first handle position (the first rotating direction) from a state in which the door handle body 10 is at the second handle position, the supporting portion 12 of the door handle body 10 moves away from the lever 30 (specifically from the first arm portion 31) and moves forward. When the user moves his or her hand away from the gripping portion 11, the supporting portion 12 is pulled rearward by the tension spring 20. Accordingly, the door handle body 10 rotates in a direction toward the second handle position (the second rotating direction), comes into abutment with the first arm portion 31, and stops at the second handle position.

In the vehicle body, a door opening-closing sensor, not illustrated, configured to sense the opening and closing state of the door is provided. When the door opening-closing sensor senses the fact that the door is opened once and then closed again, the control unit CT supplies the drive signal DS to the electric motor 51 to rotate the electric motor 51 in the reverse direction, and rotates the cam 54 from the second cam position to the first cam position. Accordingly, the door handle body 10 returns to the first handle position and stops. In other words, the door handle body 10 is accommodated in the door body D.

According to the door handle apparatus 1 described above, even when the user rotates the door handle body 10 erroneously toward the first handle position in a state in which the door handle body 10 is at the second handle position, the door handle body 10 is restored again to the second handle position only by moving the hand away from the gripping portion 11. In other words, different from the door handle apparatus of the related art described above, even when the user rotates the door handle body 10 erroneously from the second handle position toward the first handle position, an operation to restore the door handle body 10 to the second handle position is not necessary. Therefore, the operability of the door handle apparatus 1 is higher than the door handle apparatus of the related art described above.

Furthermore, the implementation of this disclosure is not limited to the above-described embodiment, and various modifications may be made without departing the object of this disclosure.

For example, the user may rotate the door handle body 10 toward the first handle position from a state in which the door handle body 10 is in the second handle position. Instead, however, the door handle body 10 may be configured to be incapable of rotating from the second handle position to the first handle position.

Figure 15:
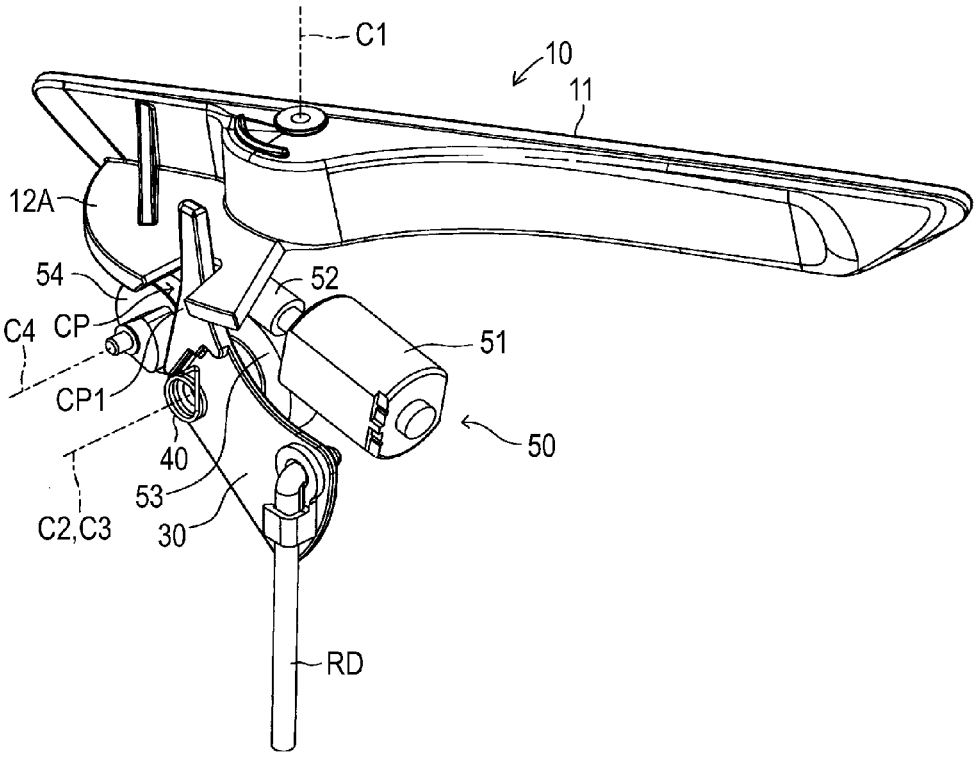
FIG. 15 is a perspective view of the door handle apparatus according to a modification of this disclosure in a state in which the door handle body is positioned at the second handle position viewed from the rear in the inside of the cabin.
Figure 16:
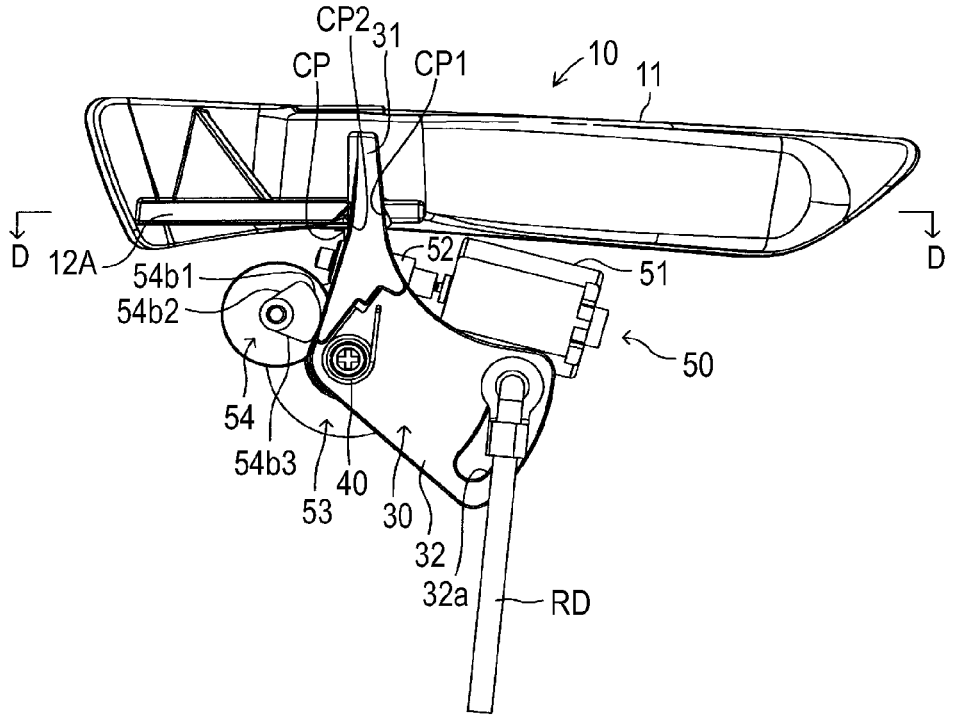
FIG. 16 is a front view of the door handle apparatus illustrated in FIG. 15 viewed from the inside of the cabin.
Figure 17:
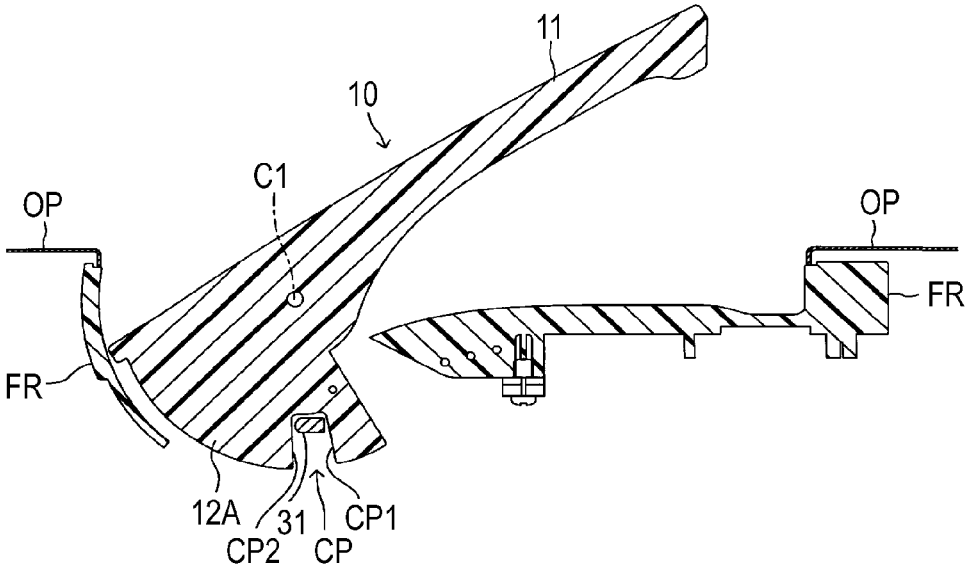
FIG. 17 is a cross-sectional view taken along the line XVII-XVII in FIG. 16.

Specifically, the supporting portion 12 of the embodiment described above, may be replaced by a supporting portion 12A as illustrated in FIG. 15 to FIG. 17. An outer peripheral portion of the supporting portion 12A is formed with a notch CP notched so as to intrude toward the rotary shaft C1, the first arm portion 31 is inserted into the notch CP. A rear surface of the first arm portion 31 comes into abutment with a wall surface CP1 (third engaging portion) on the rear side among wall surfaces which constitute the notch CP, a front surface of the first arm portion 31 comes into abutment with a wall surface CP2 (the second engaging portion) on the front side among the wall surfaces which constitute the notch CP. Therefore, the door handle body 10 cannot move away from the lever 30. Accordingly, even when the user tries to rotate the door handle body 10 toward the first handle position in a state in which the door handle body 10 is at the second handle position, since the rotational movement of the lever 30 toward the first lever position is restricted by the cam 54, the wall surface CP1 on the rear side among the wall surfaces which constitute the notch CP comes into abutment with the rear end surface of the first arm portion 31 of the lever 30, so that the door handle body 10 cannot rotate toward the first handle position (in the first rotating direction). In other words, since an event that the door handle body 10 is rotated from the second handle position to the first handle position does not occur, an operation to restore the door handle body 10 to the second handle position is not necessary. Therefore, the operability of the door handle apparatus 1 is higher than the door handle apparatus of the related art described above.

In this case, when the lever 30 rotates from the first lever position to the second handle position, the rear end surface of the first arm portion 31 comes into abutment with the wall surface CP1 on the rear side of the notch CP and presses the supporting portion 12A rearward, so that the door handle body 10 is rotated from the first handle position to the second handle position. Therefore, necessity of urging the door handle body 10 by the tension spring 20 is eliminated. Therefore, the tension spring 20 may be omitted, and hence the material cost of the door handle apparatus 1 may be reduced.

An operation of a case where the user grips the gripping portion 11 and applies a force to rotate the door handle body 10 further in the same direction (the second rotating direction) as a direction from the first handle position to the second handle position in a state in which the door handle body 10 is at the second handle position is the same as that of the embodiment described above. In other words, although the door handle body 10 rotates toward the third handle position, the door handle body 10 restores to the second handle position when the user moves his or her hand away from the gripping portion 11.

An aspect of this disclosure is directed to a door handle apparatus (1) to configured be assembled to a door body (D) of a vehicle including: a door handle body (10) configured to be supported so as to be capable of rotating by the door body; a driven member (54) configured to be supported by the door body and driven by an actuator (51); and a handle driving mechanism configured in such a manner that in a state in which the driven member is at a first driving position, the door handle body is positioned at a first handle position, and is rotated from the first handle position to a second handle position by the driven member being driven from the first driving position to a second driving position by an operation of the actuator, and in a state in which the driven member is at the second driving position, the door handle body is capable of or incapable of rotating from the second handle position in a first rotating direction when being subjected to an external force in the first rotating direction from the second handle position to the first handle position, and is capable of rotating from the second handle position to a second rotating direction opposite to the first rotating direction when being subjected to an external force in the second rotating direction, and the door handle body is subjected to an urging force in the direction of being restored to the second handle position when rotating from the second handle position by being subjected to the external force.

In this case, it is preferable that, when the door handle body is at the first handle position, a side surface of the door handle body on the outside of a cabin is configured to be flush with a side surface of a door panel on the outside of the cabin.

According to this configuration, in a state in which the driven member is positioned at the second driving position, the door handle body is restored to the second handle position again even when the door handle body is subjected to the external force and rotates from the second handle position in the first rotating direction. In other words, the door handle body is incapable of rotating from the second handle position in the first rotating direction. Therefore, different from the door handle apparatus of the related art described above, an operation to restore the door handle body to the second handle position is not necessary. Therefore, the operability is further improved in comparison with the door handle apparatus of the related art.

Another aspect of this disclosure is directed to the door handle apparatus described above, wherein the handle driving mechanism includes: a lever (30) configured to be supported so as to be capable of rotating by the door body and engage the handle body and the driven member; a first urging member (40) configured to urge the lever in a third rotating direction, which is a rotating direction of the lever; and a second urging member (20) configured to urge the door handle body in the second rotating direction, the lever is urged by the first urging member and engages the driven member, the door handle body is urged by the second urging member and engages the lever, and when the door handle body is subjected to an external force in the first rotating direction and the door handle body rotates from the second handle position in the first rotating direction in a state in which the driven member is positioned at the second driving position and the door handle body is positioned at the second handle position, the door handle body is subjected to an urging force in the direction of being restored to the second handle position on a basis of an urging force of the second urging member.

Still another aspect of this disclosure is directed to the door handle apparatus described above, wherein the door handle apparatus includes a frame (FR) configured to be fixed to the door body, and the door handle body is supported by the frame so as to be capable of rotating; the driven member is a cam (54*b*) being supported by the frame so as to be capable of rotating with respect to the frame and having a cam surface (54*b*1, 54*b*2, 54*b*3) on an outer periphery thereof, and the handle driving mechanism includes: a lever (30) supported by the frame so as to be capable of rotating with respect to the frame and engages the door handle body and the cam, a first urging member (40) configured to urge the lever in a third rotating direction, which is a rotating direction of the lever; and a second urging member (20) configured to urge the door handle body in the second rotating direction, the lever includes a first engaging portion configured to engage the cam surface on a side surface of the lever facing in the third rotating direction, the door handle body includes a second engaging portion configured to engage the side surface of the lever facing in the third rotating direction on a side surface of the door handle body facing in the second rotating direction; and the first engaging portion of the lever engages the cam surface by an urging force of the first urging member, the second engaging portion of the door handle body engages the side surface of the lever facing in the third rotating direction by an urging force of the second urging member, in a state in which the cam is at the first driving position, the lever is positioned at a first lever position by an engagement of the first engaging portion of the lever with the cam surface, the door handle body is positioned at the first handle position by an engagement of the second engaging portion of the door handle body with the side surface of the lever being positioned at the first lever position facing in the third rotating direction, the door handle body rotates from the first handle position to the second handle position while the second engaging portion of the door handle body engages the side surface of the lever facing in the third rotating direction by the rotation of the cam from the first driving position to the second driving position by an operation of the actuator, and in a state in which the cam is at the second driving position, the second engaging portion of the door handle body moves away from the side surface of the lever facing in the third rotating direction when the door handle body is subjected to an external force in the first rotating direction and is capable of rotating in the first rotating direction from the second handle position against the urging force of the second urging member, and the door handle body is subjected to an urging force in the direction of being restored to the second handle position on the basis of the urging force of the second urging member when rotating from the second handle position in the first rotating direction when being subjected to the external force in the first rotating direction.

In this configuration, even when the door handle body is rotated from the second handle position in the first rotating direction, the door handle body is urged by the second urging member and is restored to the second handle position again. Therefore, different from the door handle apparatus of the related art described above, the operation to restore the door handle body to the second handle position is not necessary. Therefore, the operability is further improved in comparison with the door handle apparatus of the related art.

Yet another aspect of this disclosure is directed to the door handle apparatus described above, wherein the handle driving mechanism includes: a lever (30) configured to be supported so as to be capable of rotating by the door body and engage the handle body and the driven member; and a first urging member (40) configured to urge the lever in a third rotating direction, which is a rotating direction of the lever; the lever is configured to be urged by the first urging member and engages the driven member, when the door handle body is subjected to an external force in the first rotating direction in a state in which the driven member is positioned at the second driving position and the door handle body is positioned at the second handle position, a rotational movement of the lever in the third rotating direction is restricted by the driven member, and a rotational movement of the door handle body from the second handle position in the first rotating direction is restricted by the driven member via the lever.

Still yet another aspect of this disclosure is directed to the door handle apparatus described above, wherein the door handle apparatus includes a frame (FR) configured to be fixed to the door body, the door handle body is supported so as to be capable of rotating by the frame; the driven member is a cam (54) being supported by the frame so as to be capable of rotating with respect to the frame and having a cam surface (54*b*1, 54*b*2, 54*b*3) on an outer periphery thereof, and the handle driving mechanism includes: a lever (30) supported by the frame so as to be capable of rotating with respect to the frame and engaging the door handle body and the cam; and a first urging member (40) configured to urge the lever in the third rotating direction, which is a rotating direction of the lever, the lever includes a first engaging portion configured to engage the cam surface on a side surface of the lever facing in the third rotating direction, the door handle body includes a second engaging portion configured to engage the side surface of the lever facing in the third rotating direction on a side surface of the door handle body facing in the second rotating direction; and a third engaging portion configured to engage a side surface of the lever facing in a fourth rotating direction opposite to the third rotating direction on a side surface of the door handle body facing in the first rotating direction, the first engaging portion of the lever is configured to engage the cam surface by an urging force of the first urging member, in a state in which the cam is at the first driving position, the lever is positioned at a first lever position by an engagement of the first engaging portion of the lever with the cam surface, the door handle body is positioned at the first handle position by engagements of the second and third engaging portions of the door handle body with side surfaces facing in the third and fourth rotating directions respectively of the lever positioned at the first lever position, the lever is rotated from the first lever position to a second lever position while the first engaging portion of the lever engages the cam surface by a rotational movement of the cam from the first driving position to the second driving position by an operation of the actuator, the door handle body is rotated from the first handle position to the second handle position while the third engaging portion of the door handle body is pressed by a side surface of the lever facing in a fourth rotating direction by a rotational movement of the lever from the first lever position to the second lever position, in a state in which the cam is at the second driving position, the door handle body is incapable of rotating from the second handle position in the first rotating direction due to an abutment of the third engaging portion of the door handle body with the side surface of the lever facing in the fourth rotating direction when being subjected to an external force in the first rotating direction, and an abutment of the first engaging portion of the lever with the cam surface.

In this configuration, in a state in which the cam is positioned at the second driving position, the door handle body cannot be rotated from the second handle position in the first rotating direction. In other words, since an event that the door handle body is rotated from the second handle position to the first handle position does not occur, the operation to restore the door handle body to the second handle position is not necessary. Therefore, the operability is further improved in comparison with the door handle apparatus of the related art.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A door handle apparatus configured to be assembled to a door body of a vehicle comprising:

a door handle body configured to be supported so as to be capable of rotating by the door body;

a driven member configured to be supported by the door body and driven by an actuator;

a handle driving mechanism configured in such a manner that in a state in which the driven member is at a first driving position, the door handle body is positioned at a first handle position, and is rotated from the first handle position to a second handle position by the driven member being driven from the first driving position to a second driving position by an operation of the actuator, and in a state in which the driven member is at the second driving position, the door handle body is capable of or incapable of rotating from the second handle position in a first rotating direction when being subjected to an external force in the first rotating direction from the second handle position to the first handle position, and is capable of rotating from the second handle position to a second rotating direction opposite to the first rotating direction when being subjected to an external force in the second rotating direction, and the door handle body is subjected to an urging force in the direction of being restored to the second handle position when rotating from the second handle position by being subjected to the external force;

a frame configured to be fixed to the door body;

wherein the door handle body is supported by the frame so as to be capable of rotating;

the driven member is a cam being supported by the frame so as to be capable of rotating with respect to the frame and having a cam surface on an outer periphery thereof;

the handle driving mechanism includes a lever supported by the frame so as to be capable of rotating with respect to the frame and engages the door handle body and the cam, a first urging member configured to urge the lever in a third rotating direction, which is a rotating direction of the lever, and a second urging member configured to urge the door handle body in the second rotating direction;

the lever includes a first engaging portion configured to engage the cam surface on a side surface of the lever facing in the third rotating direction;

the door handle body includes a second engaging portion configured to engage the side surface of the lever facing in the third rotating direction on a side surface of the door handle body facing in the second rotating direction;

the first engaging portion of the lever engages the cam surface by an urging force of the first urging member;

the second engaging portion of the door handle body engages the side surface of the lever facing in the third rotating direction by an urging force of the second urging member;

in a state in which the cam is at the first driving position, the lever is positioned at a first lever position by an engagement of the first engaging portion of the lever with the cam surface, the door handle body is positioned at the first handle position by an engagement of the second engaging portion of the door handle body with the side surface of the lever being positioned at the first lever position facing in the third rotating direction, the door handle body rotates from the first handle position to the second handle position while the second engaging portion of the door handle body engages the side surface of the lever facing in the third rotating direction by the rotation of the cam from the first driving position to the second driving position by an operation of the actuator; and in a state in which the cam is at the second driving position, the second engaging portion of the door handle body moves away from the side surface of the lever facing in the third rotating direction when the door handle body is subjected to an external force in the first rotating direction and is capable of rotating in the first rotating direction from the second handle position against the urging force of the second urging member, and the door handle body is subjected to an urging force in the direction of being restored to the second handle position on the basis of the urging force of the second urging member when rotating from the second handle position in the first rotating direction when being subjected to the external force in the first rotating direction.

2. The door handle apparatus according to claim 1, wherein when the door handle body is subjected to the external force in the first rotating direction in the state in which the driven member is at the second driving position and the door handle body is positioned at the second handle position, a rotational movement of the lever in the third rotating direction is restricted by the driven member, and a rotational movement of the door handle body from the second handle position in the first rotating direction is restricted by the driven member via the lever.

3. The door handle apparatus according to claim 1, wherein the door handle body includes a third engaging portion configured to engage a side surface of the lever facing in a fourth rotating direction opposite to the third rotating direction on a side surface of the door handle body facing in the first rotating direction, the door handle body is positioned at the first handle position by an engagement of the third engaging portion of the door handle body with side surface facing in the fourth rotating direction, the lever is rotated from the first lever position to a second lever position while the first engaging portion of the lever engages the cam surface by a rotational movement of the cam from the first driving position to the second driving position by an operation of the actuator, the door handle body is rotated from the first handle position to the second handle position while the third engaging portion of the door handle body is pressed by the side surface of the lever facing in the fourth rotating direction by a rotational movement of the lever from the first lever position to the second lever position, in the state in which the cam is at the second driving position, the door handle body is incapable of rotating from the second handle position in the first rotating direction due to an abutment of the third engaging portion of the door handle position with the side surface of the lever facing in the fourth rotating direction when being subjected to the external force in the first rotating direction, and an abutment of the first engaging portion of the lever with the cam surface.

4. The door handle apparatus according to claim 1, wherein in a state in which the door handle body is at the first handle position, a side surface of the door handle body on the outside of a cabin is configured to be flush with a side surface of a door panel on the outside of the cabin.

5. The door handle apparatus according to claim 2, wherein in a state in which the door handle body is at the first handle position, a side surface of the door handle body on the outside of a cabin is configured to be flush with a side surface of a door panel on the outside of the cabin.

6. The door handle apparatus according to claim 3, wherein in a state in which the door handle body is at the first handle position, a side surface of the door handle body on the outside of a cabin is configured to be flush with a side surface of a door panel on the outside of the cabin.

* * * * *